US010137563B1

(12) United States Patent
Moore

(10) Patent No.: US 10,137,563 B1
(45) Date of Patent: Nov. 27, 2018

(54) JEWELERS' INTERCHANGEABLE TOOL HEAD SET

(71) Applicant: Darla Moore, Clyde, TX (US)

(72) Inventor: Darla Moore, Clyde, TX (US)

( * ) Notice: Subject to any disclaimer, the term of this patent is extended or adjusted under 35 U.S.C. 154(b) by 322 days.

(21) Appl. No.: 15/096,465

(22) Filed: Apr. 12, 2016

(51) Int. Cl.
*B25F 1/02* (2006.01)
*B25F 1/00* (2006.01)

(52) U.S. Cl.
CPC ..... *B25F 1/02* (2013.01); *B25F 1/003* (2013.01); *B25F 1/006* (2013.01)

(58) Field of Classification Search
None
See application file for complete search history.

(56) References Cited

U.S. PATENT DOCUMENTS 753,456 A * 3/1904 Weidinger ..... B25B 7/02 433/147
2,606,471 A 8/1952 Kollweck
3,176,551 A 4/1965 Hansen
4,813,310 A 3/1989 Moynihan
5,542,167 A * 8/1996 Nakamoto ..... B25B 7/04 29/229
5,664,274 A * 9/1997 Collins ..... B25F 1/003 224/904
6,347,565 B2 2/2002 Steinweg
6,386,076 B1 * 5/2002 Swanstrom, Jr. ..... B25B 7/04 29/527.1
D491,780 S 6/2004 Noniewicz
7,997,170 B1 8/2011 Martinez

OTHER PUBLICATIONS

Dictionary.com Definition of Button, Apr. 2018, found at http://www.dictionary.com/browse/button, attached as pdf.*

* cited by examiner

*Primary Examiner* — Joseph J Hail
*Assistant Examiner* — Brian D Keller

(57) ABSTRACT

The jeweler's interchangeable tool head set is a tool adapted for use in making jewelry. Specifically, the jeweler's interchangeable tool head set comprises a handle and a plurality of interchangeable tool heads. Each of the interchangeable tool heads can be mounted on the handle. The handle has a spring loaded connector that is used to securely attach a first interchangeable tool head selected from the plurality of interchangeable tool heads to the handle. When a new tool is required, the first selected interchangeable tool head is removed from the handle and replaced with a second interchangeable tool head selected from the plurality of interchangeable tool heads.

8 Claims, 4 Drawing Sheets

JEWELERS' INTERCHANGEABLE TOOL HEAD SET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of metal working tools, more specifically, a multi-head tool adapted for use with jewelry.

Designing and making jewelry requires numerous tools that need to be organized and that take up a lot of space. Finding a way to reduce the organizational and space requirements of jewelry tools would increase the efficiency of jewelry making.

SUMMARY OF INVENTION

This disclosure addresses the issue described above. The jeweler's interchangeable tool head set is a tool adapted for use in making jewelry. Specifically, the jeweler's interchangeable tool head set comprises a handle and a plurality of interchangeable tool heads. Each of the interchangeable tool heads can be mounted on the handle. The handle has a spring loaded connector that is used to securely attach a first interchangeable tool head selected from the plurality of interchangeable tool heads to the handle. When a new tool is required, the first selected interchangeable tool head is removed from the handle and replaced with a second interchangeable tool head selected from the plurality of interchangeable tool heads.

These together with additional objects, features and advantages of the jeweler's interchangeable tool head set will be readily apparent to those of ordinary skill in the art upon reading the following detailed description of the presently preferred, but nonetheless illustrative, embodiments when taken in conjunction with the accompanying drawings.

In this respect, before explaining the current embodiments of the jeweler's interchangeable tool head set in detail, it is to be understood that the jeweler's interchangeable tool head set is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the jeweler's interchangeable tool head set.

It is therefore important that the claims be regarded as including such equivalent construction insofar as they do not depart from the spirit and scope of the jeweler's interchangeable tool head set. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
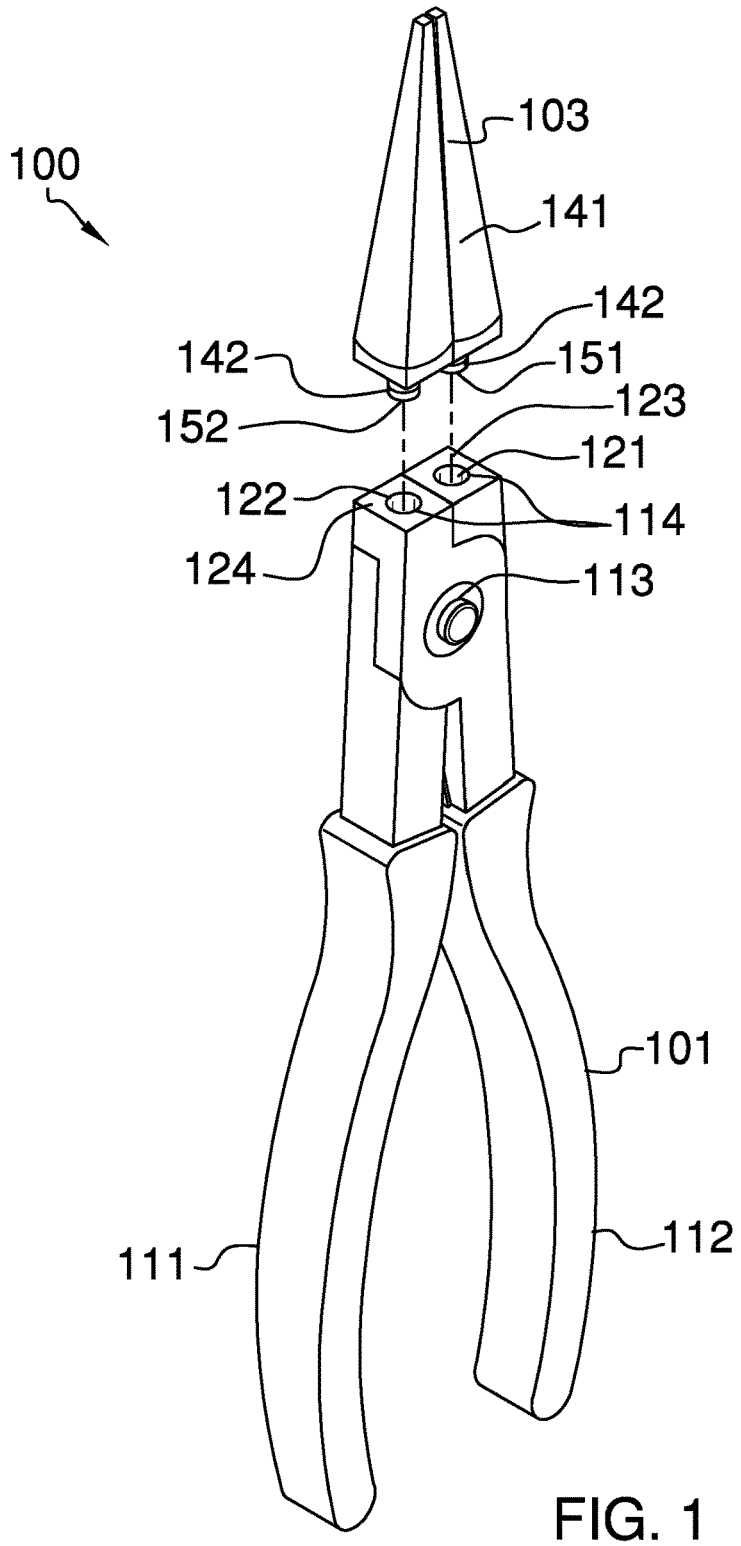
FIG. 1 is a perspective view of an embodiment of the disclosure.
Figure 2:
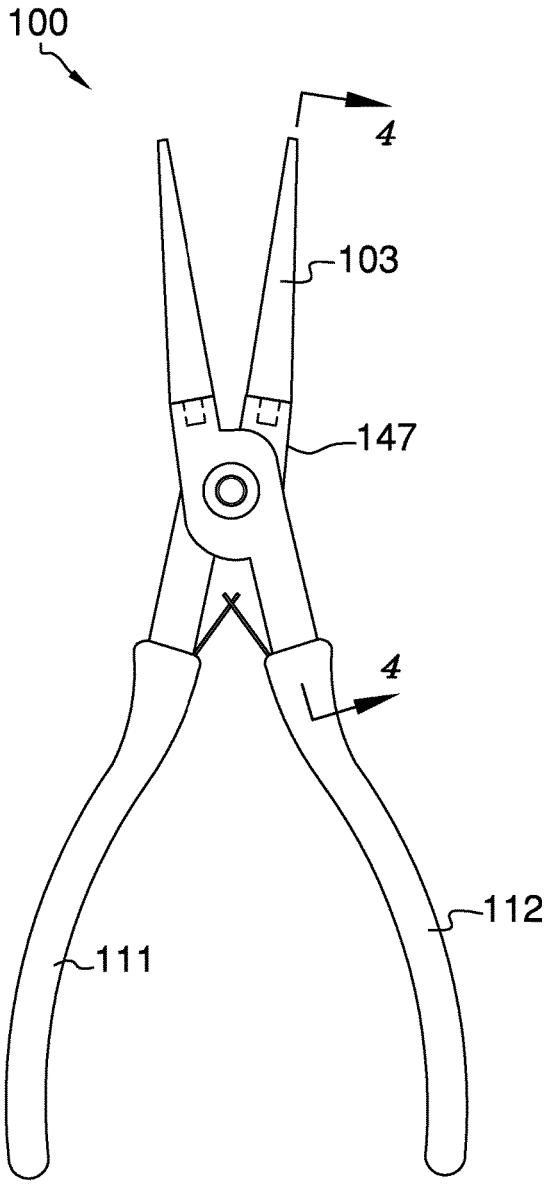
FIG. 2 is a front view of an embodiment of the disclosure.
Figure 3:
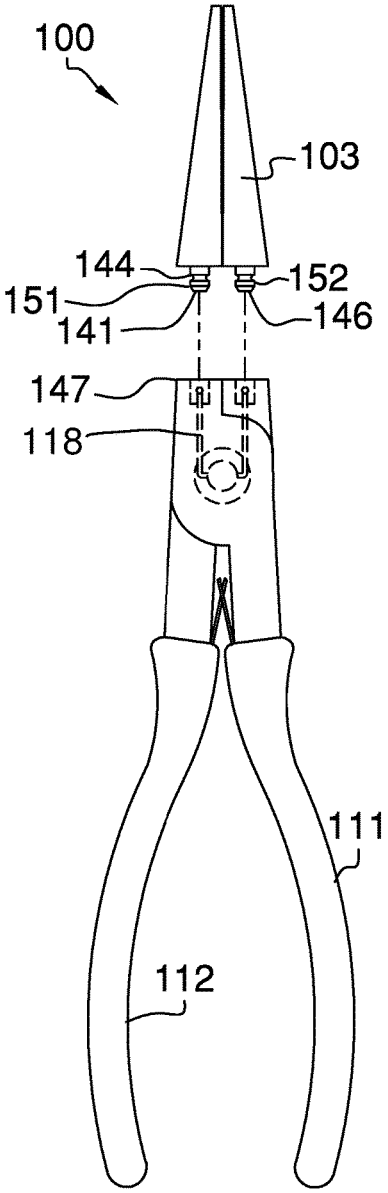
FIG. 3 is a back view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The jeweler's interchangeable tool head set 100 (hereinafter invention) comprises a handle 101 and a plurality of interchangeable tool heads 102.

The invention 100 is a tool adapted for use in making jewelry. The plurality of interchangeable tool heads 102 comprises a collection of individual tool heads 103. Each individual tool head 103 can be mounted on the handle 101. The handle 101 further comprises a spring loaded connector 104 that is used to securely attach a first individual tool head 103 selected from the plurality of interchangeable tool heads 102 to the handle 101. When a new tool is required, the first individual tool head 103 is removed from the handle 101 and replaced with a second individual tool head 103 selected from the plurality of interchangeable tool heads 102.

Each individual tool head 103 contained in the plurality of interchangeable tool heads 102 further comprises a working tool 141 and plurality of head inserts 142. Each of the plurality of head inserts 142 further comprises a projection 143, a locking groove 144, and a fitted nose 145. The working tool 141 is an implement that is designed to carry out a specific function. Each selected individual tool head 103 further comprises a specific working tool 141 that is different in function or size from the individual tool heads 103 remaining in the plurality of interchangeable tool heads 102. Suitable working tools 141 include, but are not limited to, plyers: hammers, mallets, carving tools, reamers, burnishers, scrapers, bezel pushers, flat files, needle files, prong pushers, and mandrels.

Each of the plurality of head inserts 142 further comprises a projection 143, a locking groove 144, and a fitted nose 145.

The projection 143 is a right cylindrical shaft that is attached to the working tool 141 and that projects away from the working tool 141. The projection 143 is further defined with a first free end 146. The first free end 146 is the end of the projection 143 that is not attached to the working tool 141. The locking groove 144 is a groove that is formed in the face of the projection 143 such that the plane formed by the locking groove 144 is perpendicular to the center axis of the cylinder of the projection 143. The fitted nose 145 is a shape that is formed on the first free end 146 of the projection 143. The shape of the fitted nose 145 is designed to ensure the tight fit of the individual tool head 103 in the handle 101 such that there is no "play" in the individual tool head 103 while the invention 100 is in use. In the first potential embodiment of the disclosure, as shown most clearly in FIG. 4, the fitted nose 145 is formed in the shape of a frustum of a right cone.

In the first potential embodiment of the disclosure, each individual tool head 103 further comprises a first head insert 151 and a second head insert 152.

The handle 101 further comprises a first lever 111, a second lever 112, a pivot 113, a plurality of docking ports 114, a retaining space 115, and a retaining structure 116. The first lever 111, the second lever 112, and the pivot 113 combine to form the grip of the invention 100. The first lever 111, the second lever 112, and the pivot 113 are assembled to from a set of plier handles wherein the first lever 111 and the second lever 112 can be rotated around each other to open and close a jaw type working tool 141 such as needle nose pliers 147. The design and assembly of plier handles are well known and documented in the art.

In the first potential embodiment of the disclosure, the first lever 111 is further defined with a first working end 123 and the second lever 112 is further with a second working end 124. The first working end 123 is the end of the first lever 111, which receives the first head insert 151 of an individual tool head 103 selected from the plurality of interchangeable tool heads 102. The second working end 124 is the end of the second lever 112, which receives the second head insert 152 of an individual tool head 103 selected from the plurality of interchangeable tool heads 102. The plurality of docking ports 114 further comprises a first docking port 121 and a second docking port 122. The first docking port 121 is a cavity formed in the first working end 123. The second docking port 122 is a cavity formed in the second working end 124.

Each of the plurality of docking ports 114 is a right cylindrical cavity that is formed in a working end selected from the group consisting of the first working end 123 and the second working end 124. Each of the plurality of docking ports 114 is further formed with a first opening 125 and a bottom 126. The first opening 125 is an aperture that is sized to receive a head insert selected from the group consisting of the first head insert 151 or the second head insert 152. The bottom 126 is shaped to create a space that is designed to receive the fitted nose 145 of a head insert selected from the group consisting of the first head insert 151 or the second head insert 152. When the fitted nose 145 of a head insert selected from the group consisting of the first head insert 151 or the second head insert 152 is placed in a docking port selected from the plurality of docking ports 114, the bottom 126 interacts with the selected head insert to prevent the selected head insert from shifting during the use of the invention 100.

Each lever selected from the group consisting of the first lever 111 and the second lever 112 further comprises the spring loaded connector 104. The spring loaded connector 104 attaches and detaches a head insert selected from the plurality of head inserts 142 that is inserted into the docking port associated with the selected lever. The spring loaded connector 104 further comprises the retaining space 115 and the retaining structure 116. As shown most clearly in FIG. 4, the retaining space 115 is a cavity formed within both the first lever 111 and the second lever 112 that opens, through the use of a third opening 130, into the first docking port 121 or the second docking port 122 respectively. The retaining structure 116 is a device that is inserted into the retaining space 115. The retaining space 115 further comprises a second opening 127. The second opening 127 is an aperture formed in both the first lever 111 and the second lever 112 through which the associated retaining structure 116 is inserted. The retaining structure 116 further comprises a release button 117, a cantilever 118, and a locking tab 119. The release button 117 is a cylindrical structure that is designed to fit into the second opening 127 such that the release button 117 will project beyond the lever selected from the first lever 111 or the second lever 112. The release button 117 is in effect a button that is used to release the head insert selected from the plurality of head inserts 142 from the docking port associated with the selected lever. The release button 117 is further defined with a first end 161 and a second end 162. The first end 161 is the end that projects beyond the selected lever. The cantilever 118 is a shaft that projects away from the second end of the release button 117 at an angle perpendicular to the center axis of the release button 117. The cantilever 118 is further defined with a second free end 128. The second free end 128 is the end of the cantilever 118 that is distal from the release button 117. The locking tab 119 is a structural projection (separate from the projection 143) located on the second free end 128 of the cantilever 118. The locking tab 119 projects perpendicularly away from the second free end 128 of the cantilever 118 through the third opening 130 into the docking port of the selected lever.

The locking tab 119 is positioned such that the locking tab 119 projects into the docking port selected from the plurality of docking ports 114 that is associated with the selected lever such that when the head insert selected from the plurality of head inserts 142 is inserted into the selected docking port the selected head insert presses against the locking tab 119. This pressure of the selected head insert against the locking tab 119 causes the cantilever 118 to act like a cantilever spring that is forced away from the selected head insert. When the locking tab 119 comes in contact with the locking groove 144, the energy stored within on the cantilever 118 is released pressing the locking tab 119 into the locking groove 144. The interaction between the locking tab 119 and the locking groove 144 holds the selected head insert into position.

Figure 4:
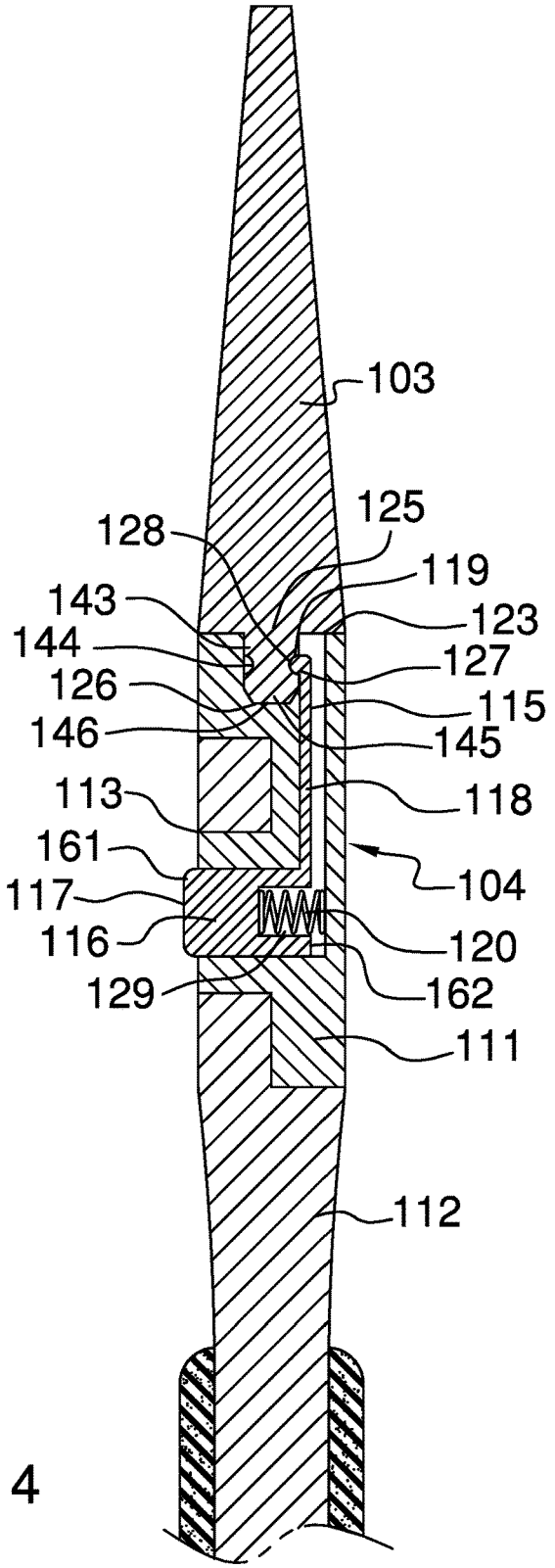
FIG. 4 is a cross-sectional view of an embodiment of the disclosure across 4-4 on FIG. 2.
Figure 5:
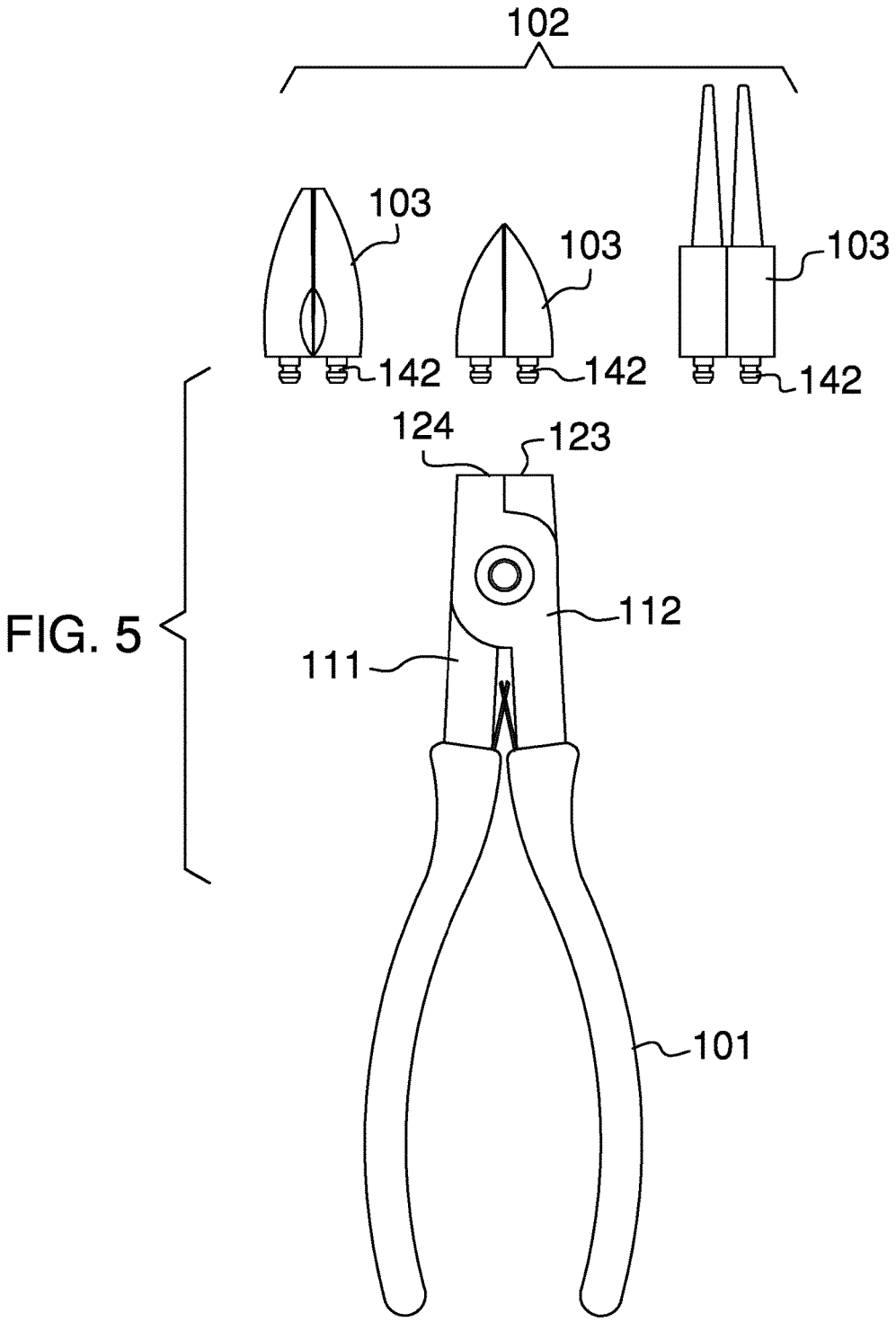
FIG. 5 is an exploded view of an embodiment of the disclosure.

As shown most clearly in FIG. 4, the release button 117 is further formed with a spring channel 129. The spring channel 129 is a cavity that is sized to receive a spring 120. Before the retaining structure 116 is inserted into the retaining space 115, the spring 120 is inserted in the spring cavity 129. The spring 120 is a commercially available helical compression spring. The role of the spring 120 is to compress when the release button 117 is depressed thereby storing energy from the depression. When the release button 117 is released, the energy stored in the spring 120 is released thereby returning the retaining structure 116 to its original position.

To use the invention 100, an individual tool head 103 is selected from the plurality of interchangeable tool heads 102 and is inserted into the handle 101 such that the first head insert 151 is inserted into the first docking port 121 and the second head insert 152 is inserted into the second docking port 122 until the individual tool head 103 is locked into position through the mechanism described above. The invention 100 is then used normally with the understanding that should an individual tool head 103 not require the capabilities provided by the pivot 113, the individual tool head 103 is formed as fixed structure that will prevent the rotation of the first lever 111 and the second lever 112. Once the job for the individual tool head 103 is completed, the release button 117 of the first lever 111 and the release button 117 of the second lever 112 are depressed simultaneously which releases the locking tabs 119 from the locking grooves 144 thereby releasing the individual tool head 103 from the handle 101.

The handle 101 and the plurality of interchangeable tool heads 102 as described in this disclosure are formed from forged and cast steel components. The spring 120 is commercially available.

The following definitions were used in this disclosure:

Cantilever: As used in this disclosure, a cantilever, is a beam or other structure that projects away from an object and is supported on only one end.

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Cone: As used in this disclosure, a cone is a surface that is generated by rotating a triangle around one of the legs of the triangle. If a line that is perpendicular to the base that is drawn from the center of the base goes through a vertex of the triangle then the cone is called a right cone.

Cylinder: As used in this disclosure, a cylinder is a geometric solid defined by two identical flat and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Frustum: As used in this disclosure, a frustum is a portion of a solid that lies between two parallel planes that intersect with the solid.

Mandrel: As used in this disclosure, a mandrel is a cylindrical rod around which metal is shaped.

Pivot: As used in this disclosure, a pivot is a rod or shaft around which an object rotates or swings.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A tool comprising:

a handle and a plurality of interchangeable tool heads;

wherein the tool is adapted for use in making jewelry;

wherein the plurality of interchangeable tool heads comprises a collection of individual tool heads;

wherein each individual tool head is optionally mounted on the handle;

wherein the handle further comprises a spring loaded connector;

wherein the spring loaded connector attaches in a removable manner a first individual tool head selected from the plurality of interchangeable tool heads to the handle;

wherein the handle comprises of a first lever, a second lever, a pivot, a plurality of docking ports, a retaining space, and a retaining structure;

wherein the first lever is further defined with a first working end;

wherein the second lever is further defined with a second working end;

wherein each of the plurality of docking ports is a right cylindrical cavity;

wherein each of the plurality of docking ports is further formed with a first opening and a bottom;

wherein the plurality of docking ports further comprises a first docking port and a second docking port;

wherein the first docking port is formed in the first working end;

wherein the second docking port is formed in the second working end;

wherein a lever selected from the group consisting of the first lever and the second lever further comprises the spring loaded connector;

wherein the spring loaded connector further comprises a retaining space and a retaining structure;

wherein the retaining space further comprises a second opening;

wherein the retaining space opens into the docking port of the lever associated with the spring loaded connector using a third opening;

wherein the retaining structure is positioned in the retaining space;

wherein the retaining structure further comprises a release button, a cantilever, and a locking tab;

wherein the release button is further formed with a spring channel;

wherein the release button is further defined with a first end and a second end;

wherein the release button is a cylindrical structure that is designed to fit into the second opening such that the first end of the release button will project beyond the lever associated with the spring loaded connector;

wherein the cantilever is a shaft that projects away from the second end of the release button at an angle perpendicular to the center axis of the release button;

wherein the cantilever is further defined with a second free end;

wherein the locking tab projects perpendicularly away from the second free end of the cantilever;

wherein the locking tab is positioned such that the locking tab projects into the docking port of the lever associated with the spring loaded connector;

wherein a spring channel is a cavity that is sized to receive a spring;

wherein the spring is inserted in the spring cavity;

wherein the spring is a helical compression spring.

2. The tool according to claim 1 wherein each individual tool head contained in the plurality of interchangeable tool heads further comprises a working tool and plurality of head inserts;

wherein each of the plurality of head inserts further comprises a projection, a locking groove, and a fitted nose.

3. The tool according to claim 2 wherein the projection is a right cylindrical shaft that is attached to the working tool and that projects away from the working tool;

wherein each of the projections is further defined with a first free end.

4. The tool according to claim 3 wherein each of the locking grooves is a groove that is formed in a face of each of the projections.

5. The tool according to claim 4 wherein the plurality of head inserts is further defined with a first head insert and a second head insert.

6. The tool according to claim 1 wherein each individual tool head contained in the plurality of interchangeable tool heads further comprises a working tool and a plurality of head inserts;

wherein each of the plurality of head inserts further comprises a projection, a locking groove, and a fitted nose;

wherein each of the projections is a right cylindrical shaft that is attached to the working tool and that projects away from the working tool;

wherein the projection is further defined with a first free end;

wherein each of the locking grooves is a groove that is formed in a face of the projection;

wherein the fitted nose is positioned at the first free end;

wherein each of the fitted noses is formed in the shape of a frustum of a right cone;

wherein the plurality of head inserts is further defined with a first head insert and a second head insert.

7. The tool according to claim 6 wherein the first docking port receives the first head insert of the individual tool head selected from the plurality of interchangeable tool heads;

wherein the second docking port receives the second head insert of an individual tool head selected from the plurality of interchangeable tool heads.

8. The tool according to claim 7 wherein the locking tab presses against the head insert associated with the docking port associated with the lever associated with the spring loaded connector.

* * * * *